US005873476A

United States Patent [19]

Takahashi et al.

[11] Patent Number: 5,873,476

[45] Date of Patent: Feb. 23, 1999

[54] CAP OPENING AND CLOSING MECHANISM

[75] Inventors: Norio Takahashi; Yukio Ojima, both of Kanagawa, Japan

[73] Assignee: NIFCO, Inc., Kanagawa, Japan

[21] Appl. No.: 986,533

[22] Filed: Dec. 8, 1997

Related U.S. Application Data

[62] Division of Ser. No. 538,400, Oct. 3, 1995, Pat. No. 5,746, 338.

[30] Foreign Application Priority Data

Oct. 5, 1994 [JP] Japan ..... 6-241560
May 11, 1995 [JP] Japan ..... 7-113195

[51] Int. Cl.[6] ..... B65D 43/16; B65D 43/26; B65D 51/18

[52] U.S. Cl. ..... 215/237; 215/295; 220/254; 220/263; 220/283; 220/337

[58] Field of Search ..... 215/237, 238, 215/239, 240, 241, 242, 305, 295, 235, 303; 220/253, 254, 262, 263, 264, 282, 281, 283, 335, 334, 259, 329, 333, 332

[56] References Cited

U.S. PATENT DOCUMENTS 3,964,609 6/1976 Perrella ..... 220/263
4,009,794 3/1977 Zapp ..... 215/305 X
4,303,173 12/1981 Nergard ..... 220/264 X
4,607,768 8/1986 Taber et al. ..... 215/237 X
4,911,337 3/1990 Rosenthal ..... 220/335 X
5,031,784 7/1991 Wright ..... 220/283 X
5,038,957 8/1991 Gross ..... 220/335
5,065,911 11/1991 Rohr et al. ..... 215/238 X
5,356,025 10/1994 Renault ..... 220/263
5,492,238 2/1996 Scholl et al. ..... 220/263

*Primary Examiner*—Stephen J. Castellano
*Assistant Examiner*—Niki M. Eloshway
*Attorney, Agent, or Firm*—Cowan, Liebowitz & Latman, P.C.

[57] ABSTRACT

A cap includes a cap body attached to a discharge port portion of a container and having a pouring port through which a content of the container can be discharged, and a lid pivotally supported by the cap body and capable of opening and closing the pouring port. The cap is provided with: a pushing member whose intermediate portion is pivotally supported by a pivotally supporting portion on a side surface of the cap body, the pushing member being swingable about the pivotally supporting portion; and a thin-walled hinge for connecting an end portion of the pushing member and a rotatably supporting portion of the lid, the thin-walled hinge being adapted to convert swinging motion of the pushing member into motion for opening or closing the lid as an upper portion or a lower portion of the pushing member is operated by being pushed.

6 Claims, 16 Drawing Sheets

CAP OPENING AND CLOSING MECHANISM

This application is a divisional of application Ser. No. 08,538,400, filed Oct. 3, 1995, now U.S. Pat. No. 5,746,338.

BACKGROUND OF THE INVENTION

1. Field of the Invention

The present invention relates to a cap opening and closing mechanism which is attached to a discharge port portion of a container.

2. Description of the Related Art

As a cap which is fitted to a discharge port of a container in which a seasoning such as salt or pepper is filled, there is a type which has a structure for opening and closing a lid by a so-called push-and-push mechanism in view of the ease of use.

As shown in FIGS. 14 to 18, in a cap 300 of this type, a button 304 which is adapted to be pushed is provided on a side surface of a hollow cylindrical cap body 303 attached to a container 302.

A slide lever 308 is connected to a reverse surface of the button 304 by means of a thin-walled hinge 306 in such a manner as to be swingable with respect to the button 304. This slide lever 308 is passed through a housing 310 disposed in such a manner as to traverse the discharge port of the container 302, and reaches a rotatably supporting portion of a lid 314 which is rotatably attached to the cap body 303 by means of a rotating shaft 312.

An elongated hole 316 is formed in the slide lever 308 along a longitudinal direction thereof. A pin 313 provided at one end of a link lever 318 is swingably inserted in the elongated hole 316, so that the link lever 318 is movable while swinging. Further, the link lever 318 is urged toward the rotatably supporting portion of the lid 314 by means of a spring 320 which is held by the slide lever 308.

Meanwhile, an engaging recessed portion 322 is provided at the other end of the link lever 318. In a state in which the lid 314 is closed, the engaging recessed portion 322 is slidably engaged with a receiving portion 324 which is provided on the rotatably supporting portion of the lid 314 and projects from a lower side of the rotating shaft 312 toward the button 304. In addition, pressing surfaces 326, 328, and 330 against which a distal end of the slide lever 308 abuts in steps are formed on the reverse surface of the lid 314.

In such a structure of the cap 300, as shown in FIG. 15, in the state in which the lid 314 is closed, the distal end of the slide lever 308 is opposed to the pressing surface 326. At this time, the link lever 318 presses the receiving portion 324 by the urging force of the spring 320. Accordingly, counterclockwise angular moment is produced about the rotating shaft 312. Consequently, the lid 314 is maintained in the closed state, so that the lid 314 cannot be opened inadvertently.

Next, if the button 304 is pushed, as shown in FIG. 16, the slide lever 308 first presses the pressing surface 328 and then presses the pressing surface 326 of the lid 314, thereby inclining the lid 314. Consequently, the receiving portion 324 rotates clockwise about the rotating shaft 312 such that a tip of the receiving portion 324 comes to be located at a position higher than that of the rotating shaft 312.

At this time, the link lever 318 moves along the elongated hole 316 against the urging force of the spring 320, and the engaging recessed portion 322 moves to a position higher than that of the distal end of the slide lever 308 while being guided by the receiving portion 324, thereby producing clockwise angular moment about the rotating shaft 312. As a result, even if the lid 314 is not completely opened by pushing the slide lever 308, the lid 314 is automatically opened to its completely open state.

Here, if the operator releases his or her finger from the button 304, as shown in FIG. 17, the slide lever 308 together with the button 304 moves in the direction of arrow A by the urging force of the spring 320, and the distal end of the slide lever 308 moves from the pressing surface 326 to the pressing surface 330 located below the rotating shaft 312. In addition, at this time, the link lever 318 presses the receiving portion 324, which has been moved to the position higher than the that of the rotating shaft 312, by the urging force of the spring 320, so that the lid 314 is maintained in the open state without rattling.

Next, if the button 304 is pushed, the slide lever 308 presses the pressing surface 330 located below the rotating shaft 312, so that counterclockwise angular moment is produced in the rotatably supporting portion of the lid 314, thereby closing the lid 314. A shown in FIG. 18, when the receiving portion 324 moves to the position below the rotating shaft 312 by the rotation of the lid 314, the link lever 318 pushes down the receiving portion 324 by the urging force of the spring 320, so that the lid 314 is automatically closed.

That is, in the structure of this cap, the closed or open state of the lid 314 can be maintained as the tip of the receiving portion 324 of the lid 314 which has been rotated about the rotating shaft 312 is pressed by the action of the link lever 318 supported rotatably and slidably by the slide lever 308. In addition, even if the lid 314 is not completely opened or closed by the slide lever 308, the lid 314 is automatically opened or closed from a predetermined position by the link lever 318 urged by the spring 320.

However, in commodities which are premised on mass production as in the case of caps of containers, it is required that the number of component parts be small and the structure be simple in the light of assembly and production cost.

In addition, since the slide lever 308 for imparting the pressing force from the button 304 to the rotatably supporting portion of the lid 314 traverses the discharge port of the container 302, a fixed limitation is imposed on a discharge rate at the discharge port.

Further, with the conventional cap 300, since the ability of the lid to hermetically seal the container 302 is low, if the container 302 containing a liquid topples over, there are cases where the liquid leaks from the gap.

SUMMARY OF THE INVENTION

In view of the above-described facts, it is an object of the present invention to provide a cap opening and closing mechanism in which the number of component parts used is small, and whose lid can be opened and closed by the so-called push-and-push mechanism without adopting a structure in which the discharge port is traversed.

Another object of the present invention is to provide a cap opening and closing mechanism in which even if the container is toppled over with the lid closed, the liquid does not leak from the discharge port.

In accordance with the present invention, there is provided a cap opening and closing mechanism including a cap body attached to a discharge port portion of a container and having a pouring port through which a content of the container can be discharged, and a lid pivotally supported by the cap body and capable of opening and closing the pouring port, the cap comprising: a pushing member whose intermediate portion is pivotally supported by a pivotally supporting portion on a side surface of the cap body, the pushing member being swingable about the pivotally supporting portion; and connecting means for connecting an end portion of the pushing member and a rotatably supporting portion of the lid, the connecting means being adapted to convert swinging motion of the pushing member into motion for opening or closing the lid.

In the present invention, the cap body having an opening is attached to the discharge port portion of a container, and the opening can be opened or closed as the lid pivotally supported by the cap body is opened or closed.

The intermediate portion of the pushing member is pivotally supported at the pivotally supporting portion on a side surface of the cap body, and the pushing member is swingable about the pivotally supporting portion as either end portion of the pushing member is pushed. One end of the pushing member is connected to an axially supporting portion of the lid by means of the connecting means.

Here, if one end portion of the pressing member is pushed, the pushing member swings about the axially supporting portion, and the connecting means, in turn, presses the axially supporting portion of the lid toward the inner side of the cap body. As a result, angular moment acting in the direction in which the lid is opened is produced about the axially supporting portion of the lid, thereby opening the lid.

Then, if the other end portion of the pressing member is pushed, the pushing member swings about the axially supporting portion, and the connecting means, in turn, pulls the axially supporting portion of the lid toward the outer side of the cap body. As a result, angular moment acting in the direction in which the lid is closed is produced about the axially supporting portion of the lid, thereby closing the lid.

Thus, as the connecting means for converting the swinging motion of the pushing member into motion for opening or closing the lid is provided on the axially supporting portion of the lid, it is possible to construct a lid opening/closing mechanism of a push-and-push type having a simple structure.

In addition, in the present invention, a slit is formed in a connecting portion between the coupling means and the pushing member so as to provide a spring hinge structure. Consequently, if the pushing member is swung, and even if the lid is not completely opened or closed, the lid is automatically opened or closed by the urging force of the spring hinge after the lid is opened or closed by a predetermined angle.

Further, in the present invention, locking means is provided at one end of the pushing member, and is capable of engaging in or disengaging from grooves formed in the cap body.

Accordingly, even if the pushing member is not continued to be pushed, the pushing member can be locked, so that the closed state of the cap can be maintained. Even if the spring hinge is not provided, the lid does not rattle.

The above and other objects, features and advantages of the present invention will become more apparent from the following detailed description of the invention when read in conjunction with the accompanying drawings.

DESCRIPTION OF THE PREFERRED EMBODIMENTS

Figure 1:
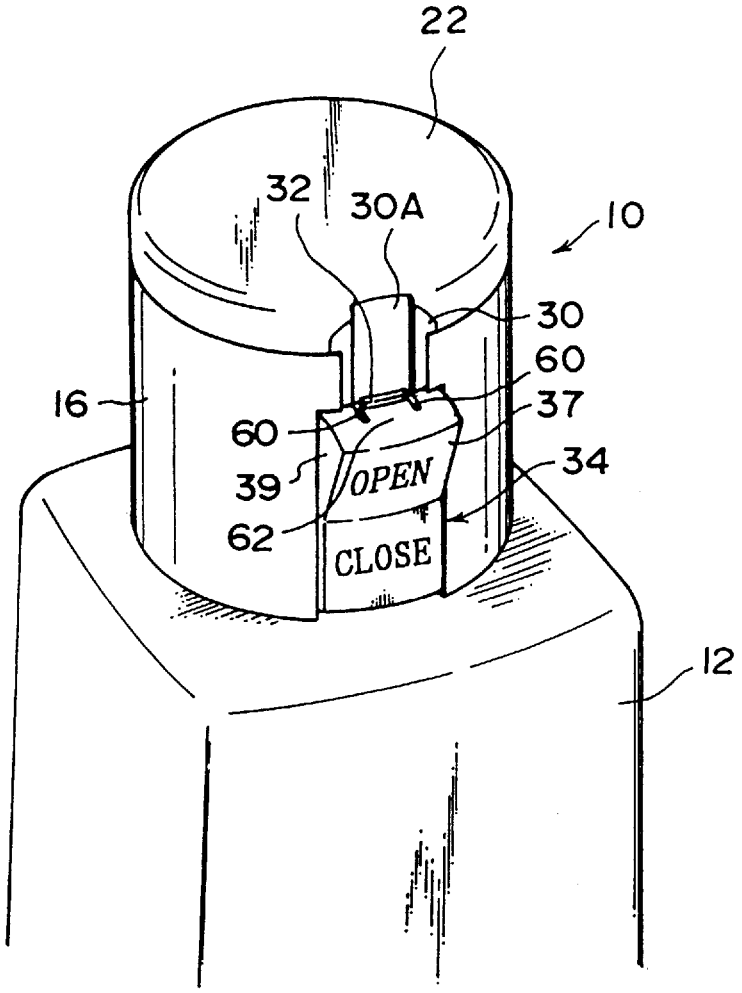
FIG. 1 is a perspective view illustrating a cap in accordance with a first embodiment.
Figure 2:
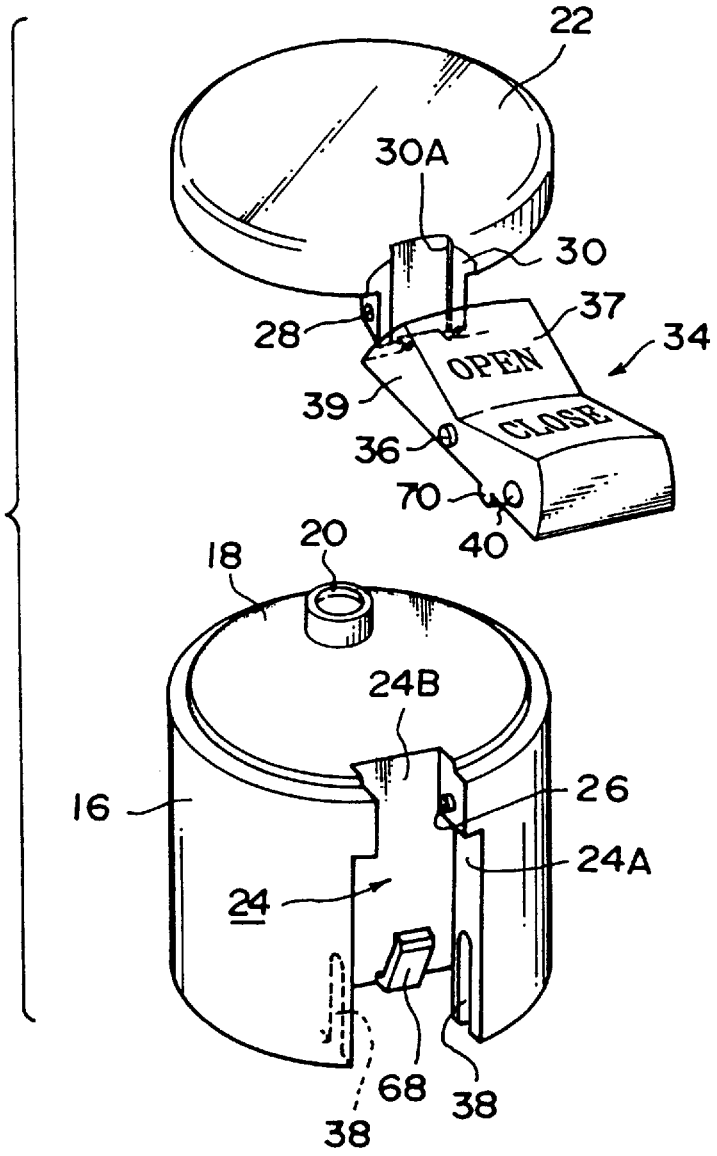
FIG. 2 is an exploded perspective view illustrating the cap in accordance with the first embodiment.

As shown in FIGS. 1 to 4, a cap 10 in accordance with a first embodiment has a hollow cylindrical cap body 16 which is attached to a discharge port portion of a container 12.

The discharge port portion of the container 12 is inserted in the cap body 16, and the content of the container 12 is discharged through a hollow cylindrical portion 20 which passes through and projects from the top surface 18 of the cap body 16. Incidentally, a hollow cylindrical insert 23 formed on a reverse surface of a lid 22, which will be described later, is inserted in the hollow cylindrical portion 20 when the lid 22 is closed.

Meanwhile, a part of the side surface portion i.e., a side wall of the cap body 16 is recessed in a vertical direction to form an accommodating portion 24. Each of a pair of shafts 26 projects from the upper portion of a side wall 24A of this accommodating portion 24. Each of a pair of shaft holes 28, which is formed in a shaft body 30 protruding orthogonally from an outer peripheral portion of the circular lid 22, is rotatably receives to the respective shaft 26. A recessed portion 30A is formed on an outer surface of the shaft body 30, and an upper end of a pushing member 34 is connected to a lower end thereof (on the lower side of the shaft holes 28) by means of a thin/walled hinge 32.

As shown in FIG. 1, two slits 60 are formed at an upper end of the pushing member 34 in such a manner that the thin-walled hinge 32 is provided between the slits 60. A remaining portion which is not cut out by the slits 60 is formed as a leaf spring 62, and is capable of exerting a deflecting urging force toward the inner side (see FIG. 5).

The pushing member 34 has the shape of a box with a hollow interior, and the top surface 37 is inclined from longitudinally opposite ends of the pushing member 34 toward its center in such a manner as to reduce the height of side walls 39. A pair of shafts 36 is respectively provided projectingly on central portions of both side walls 39. These shafts 36 are respectively inserted from below into a pair of elongated grooves 38 formed vertically in the side walls 24A of the accommodating portion 24. Consequently, the pushing member 34 is swingable about the shafts 36 which are pivotally supported in the respective elongated grooves 38.

In addition, a pair of projections 40, which are provided projectingly on lower end portions of the side walls 39 of the pushing member 34, is engaged in the elongated grooves 38 while inwardly deflecting the side walls 39, and can be disengaged from the elongated grooves 38. Consequently, when the lower side of the pushing member 34 is pushed, the projections 40 engage in the elongated grooves 38, thereby locking the pushing member 34.

Further, a rib 66 is formed inside the pushing member 34 at its longitudinal center, and abuts against a retaining piece 68 which juts diagonally upward from a lower end of the accommodating portion 24, so that the rotating shafts 36 are held so as to not be removed from the elongated grooves 38. In addition, a stopper 70 is provided projectingly on a lower end portion of the pushing member 34, and abuts against a bottom surface 24B of the accommodating portion 24, thereby restricting the swinging motion of the pushing member 34 within a fixed range.

Next, a description will be given of the operation of the cap in accordance with the above-described embodiment.

Figure 4:
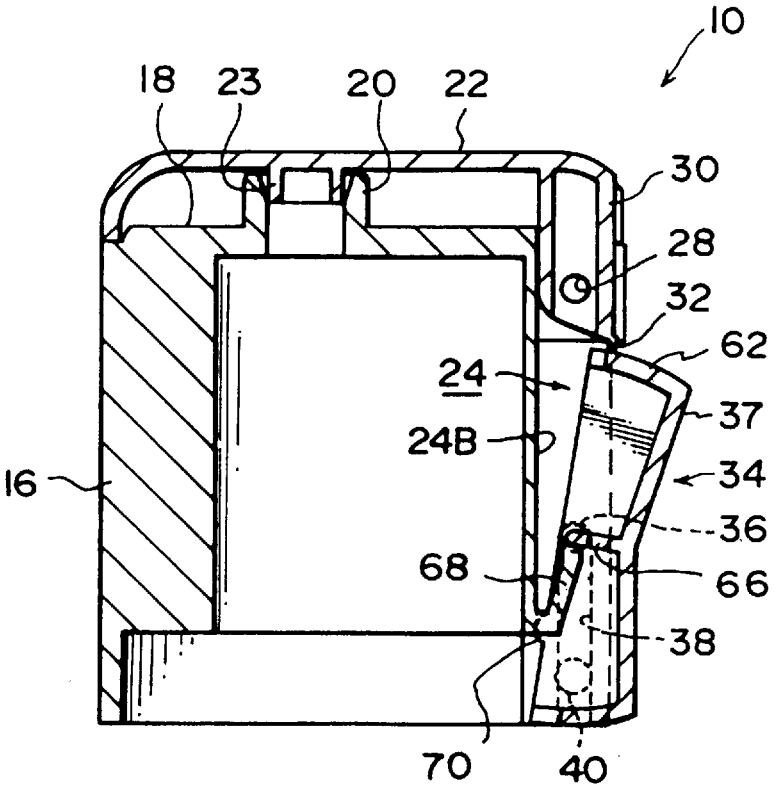
FIG. 4 is a cross-sectional view illustrating the opening/closing operation of a lid of the cap in accordance with the first embodiment.

As shown in FIG. 4, in the state in which the lid 22 is closed, the lower end of the pushing member 34 is pushed toward the bottom surface 24B side, and the projections 40 are engaged in the elongated grooves 38, thereby locking the pushing member 34. In this state, since a force for pulling the lower end (the lower side of the shaft holes 28) of the shaft body 30 toward the outer side of the cap body 16 acts on the thin-walled hinge 32, angular moment in the direction in which the lid 22 is closed is produced about the rotating shafts 28 of the lid 22. For this reason, the lid 22 is maintained in its closed state.

Figure 3:
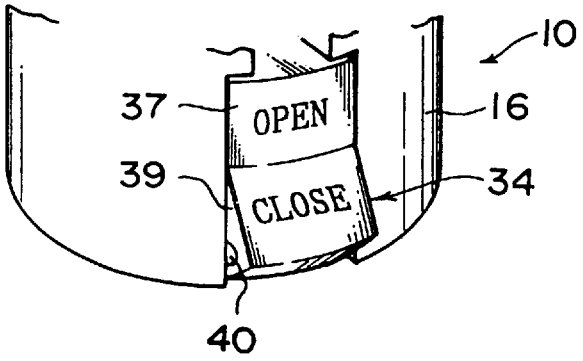
FIG. 3 is a perspective view illustrating a locked state of a pushing member of the cap in accordance with the first embodiment.
Figure 5:
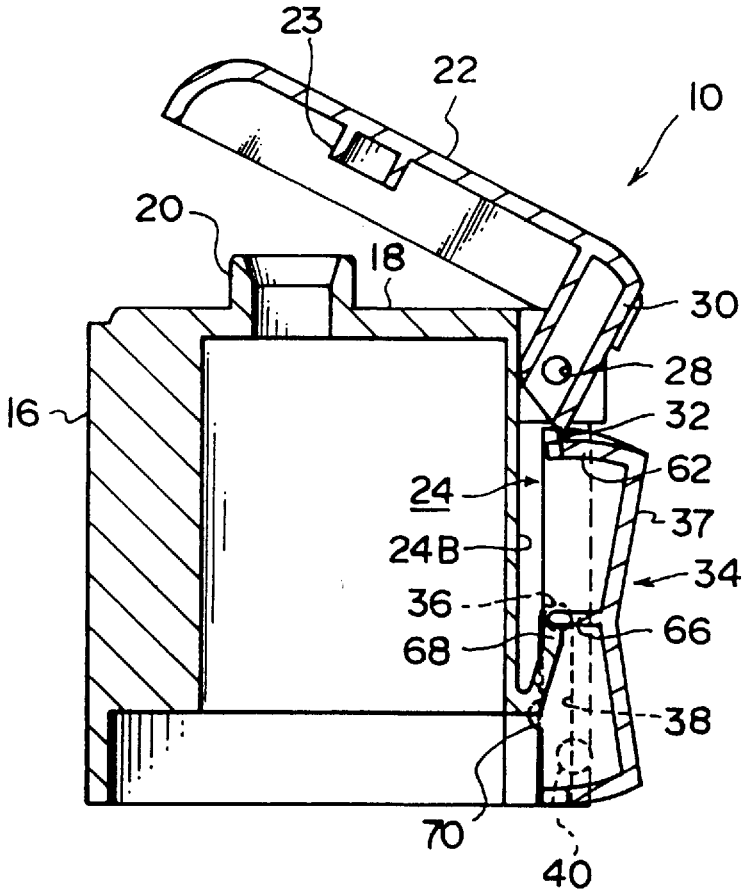
FIG. 5 is a cross-sectional view illustrating the opening/closing operation of the lid of the cap in accordance with the first embodiment.
Figure 6:
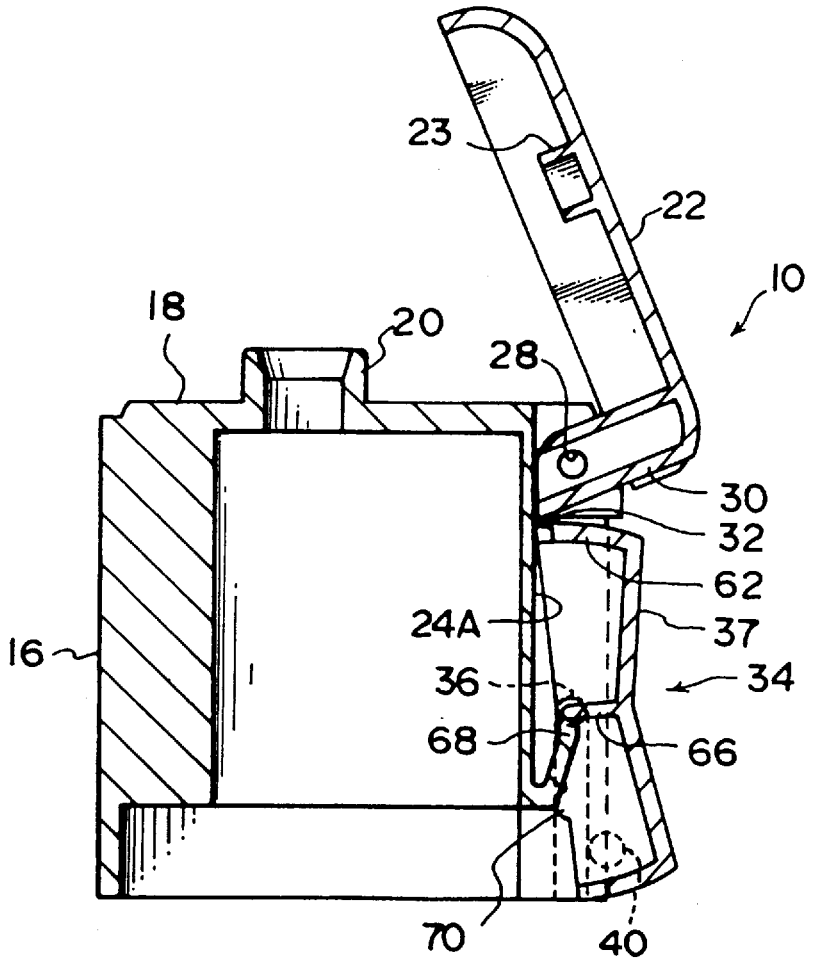
FIG. 6 is a cross-sectional view illustrating the opening/closing operation of the lid of the cap in accordance with the first embodiment.

Here, if the upper end of the pushing member 34 is pushed as shown in FIG. 5, the projections 40 are disengaged from the elongated grooves 38, thereby allowing the pushing member 34 to swing about the rotating shafts 36. Consequently, a force for pushing the lower end of the shaft body 30 toward the bottom surface 24B side acts on the thin-walled hinge 32, so that the lid 22 is opened gradually. At this time, the leaf spring 62 is deflected inwardly, and the thin-walled hinge 32 is pressed further toward the bottom surface 24B side by the spring force. For this reason, as shown in FIG. 6, angular moment in the direction of opening the lid 22 is produced about the shafts 28, and when the lid 22 is opened by a predetermined angle, the lid 22 is automatically opened. Here, as shown in FIG. 3, since the projections 40 abut against the outer edges of the accommodating portion 24, the swinging motion of the pushing member 34 is stopped in this state, and the lid 22 is locked in its open state.

Next, if the lower end of the pushing member 34 is pushed, the pushing member 34 swings about the shafts 36, and the projections 40 engage in the elongated grooves 38, thereby locking the pushing member 34. Through this operation, a force for pulling the lower end (the lower side of the shaft holes 28) of the shaft body 30 toward the outer side of the cap body 16 acts on the thin-walled hinge 32, thereby closing the lid 22. At this time, the amount of the pushing member 34 pushed in is restricted as the stopper 70 abuts against the side surface of the cap body 16.

Although, in this embodiment, the slits 60 are formed at the upper end of the pushing member 34 to constitute the leaf spring 62, the lid 22 can be opened and closed by the thin-walled hinge 32 alone.

Thus, in the present invention, the number of component parts is small, and the lid can be opened and closed by the so-called push-and-push mechanism without adopting the structure in which the discharge port is traversed.

Figure 7:
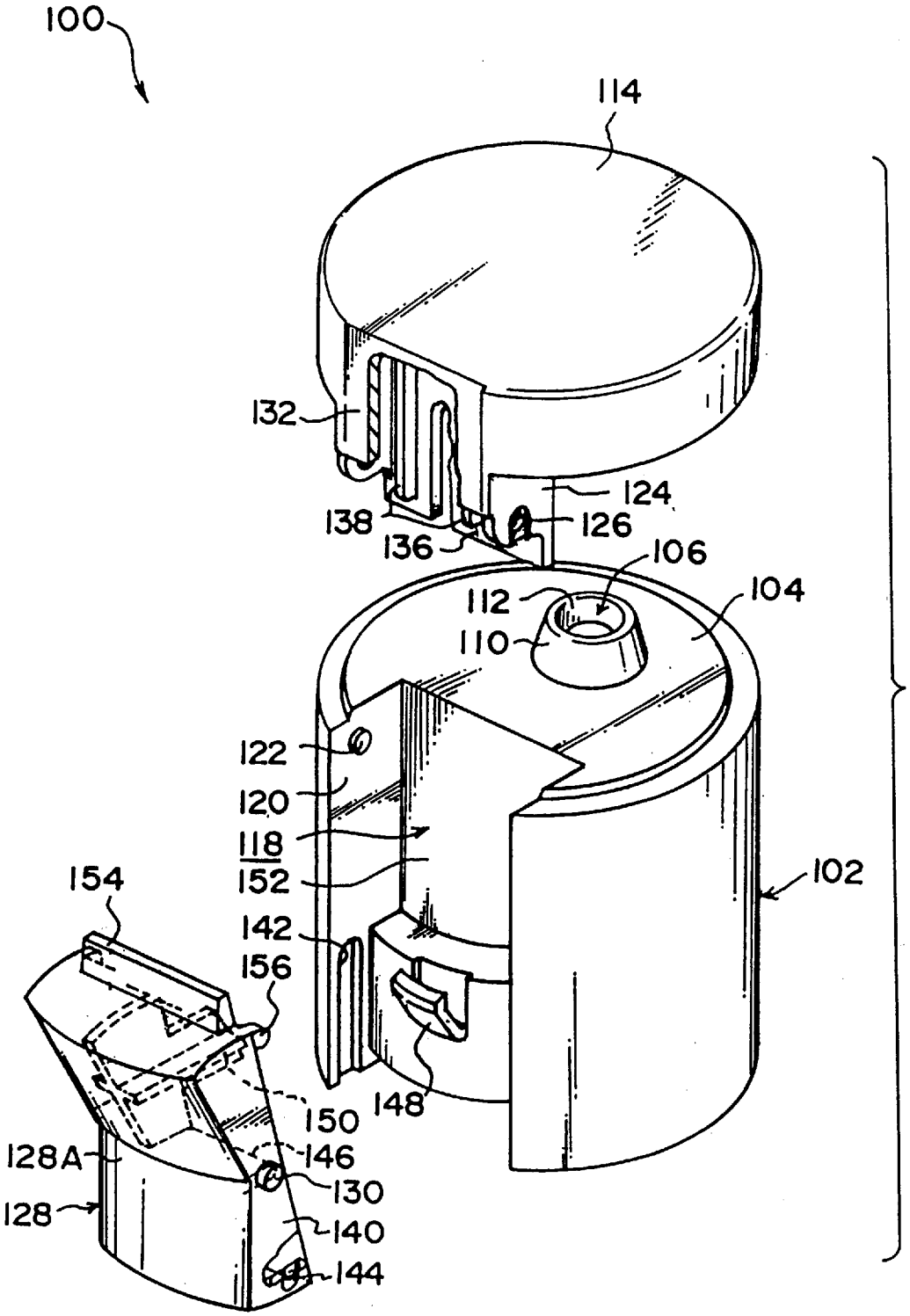
FIG. 7 is an exploded perspective view illustrating the cap in accordance with a second embodiment.
Figure 8:
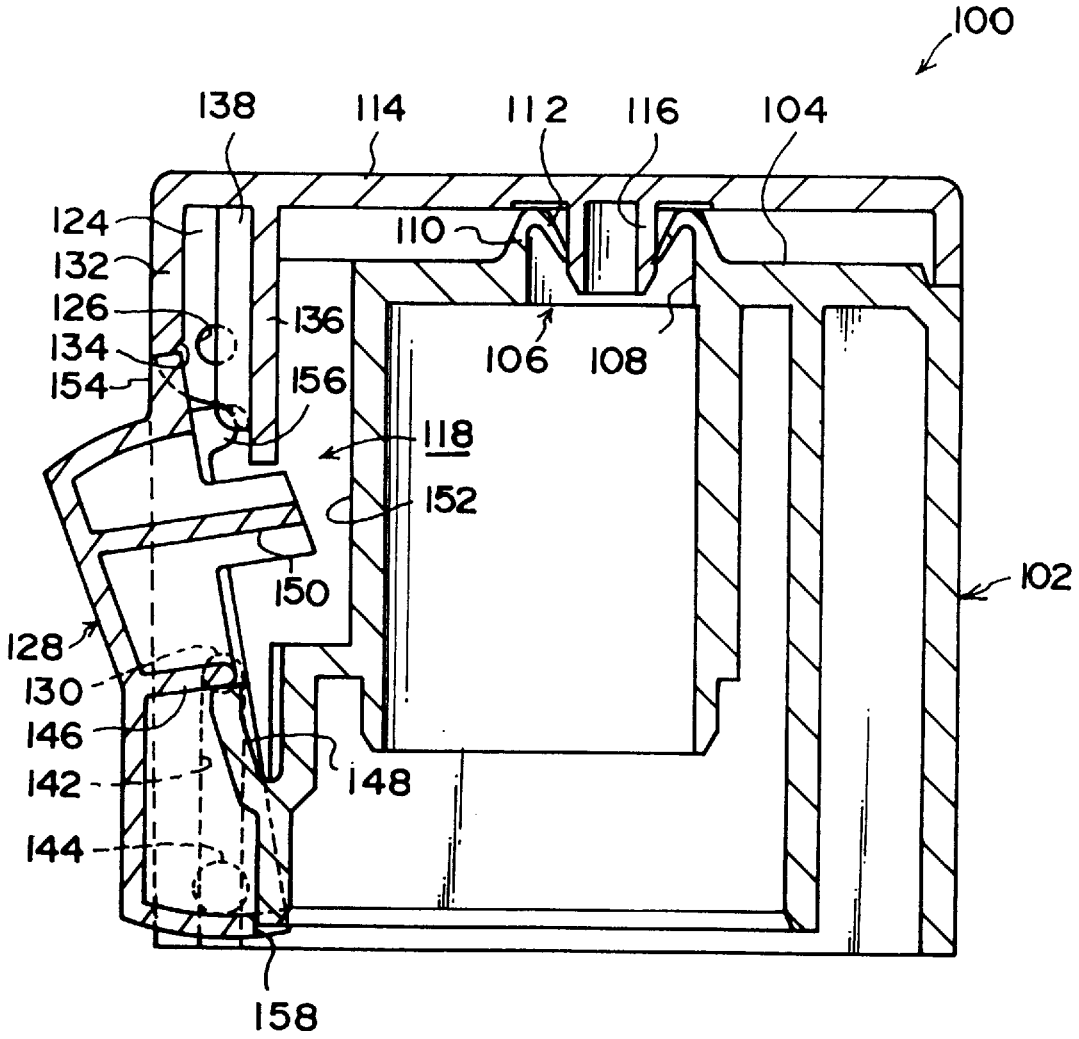
FIG. 8 is a cross-sectional view of the cap in accordance with the second embodiment when the lid is closed.
Figure 9:
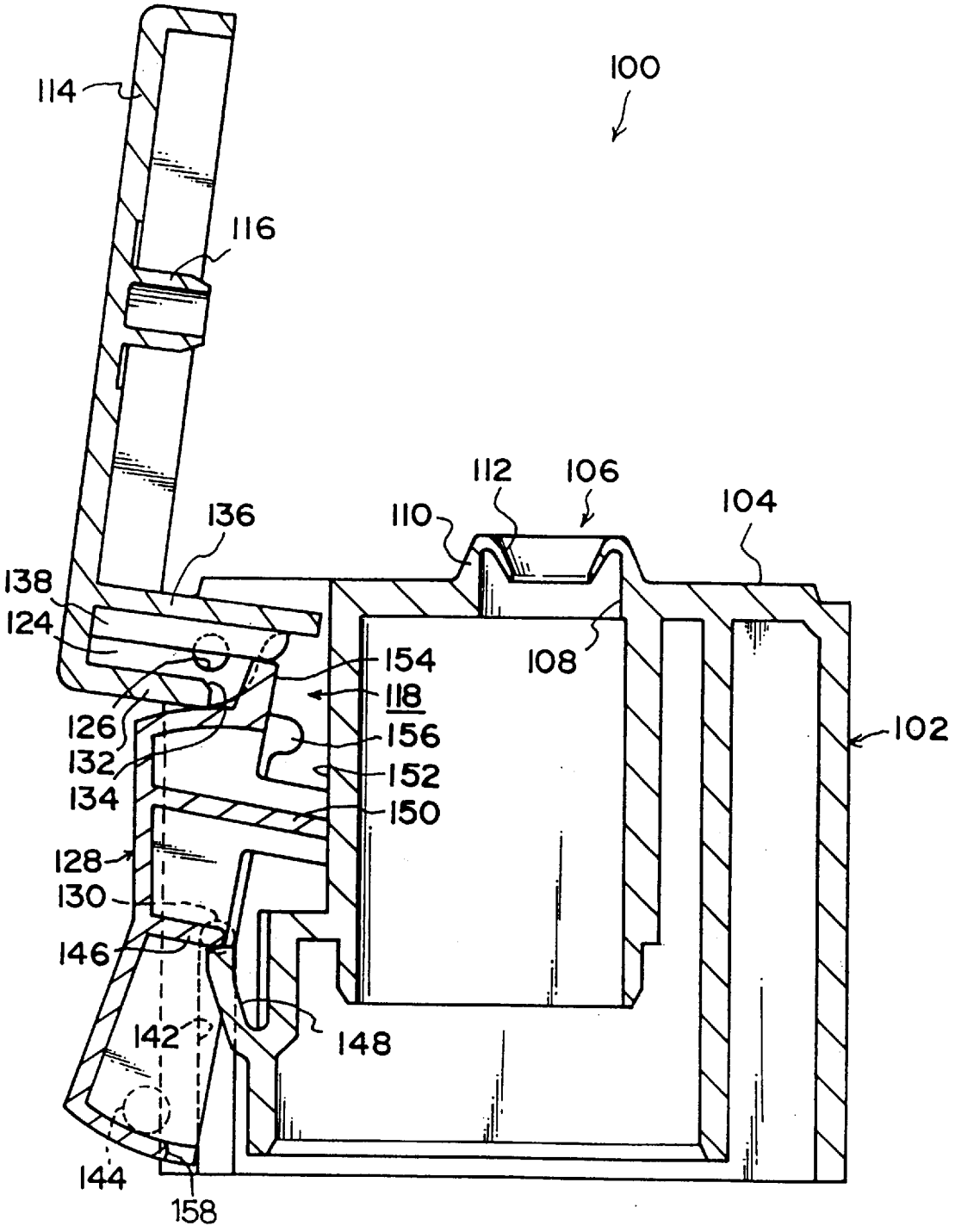
FIG. 9 is a cross-sectional view of the cap in accordance with the second embodiment when the lid is open.

FIGS. 7 to 9 show a cap 100 in accordance with a second embodiment of the present invention.

This cap 100 has a hollow cylindrical cap body 102 which is attached to a discharge port portion of an unillustrated container.

A pouring port 106 is formed, on a top surface 104 of the cap body 102, by an opening 108 and a hollow cylindrical body 110 projecting uprightly from the periphery of the opening 108. The content of the container is discharged from this pouring port 106.

A thin-walled flexible piece 112 having the shape of an inverted hollow truncated cone and narrowed down toward the interior of the cap body 102 from at an upper end of the hollow cylindrical body 110 is formed as a sealing means. As will be described later, when a hollow cylindrical insert 116 formed on a reverse surface of a lid 114 is inserted into the pouring port 106, an outer periphery of the insert 116 is sealed by the thin-walled flexible piece 112.

A portion of the side surface of the cap body 102 is recessed to form an accommodating portion 118. A pair of shafts 122 is provided projectingly on a pair of side walls 120 of the accommodating portion 118 at upper portions thereof, respectively.

A shaft body 124 protrudes downward from an outer peripheral portion of the lid 114. The shafts 122 are rotatably fitted in a pair of shaft holes 126 provided in the shaft body 124.

A wall portion 132 projects from the outside of the shaft holes 126 of the lid 114 toward shafts 130 of a pushing member 128 which will be described later. A corner of a distal end of the wall portion 132 is cut to form a taper 134. A wall portion 136 projects from the inside of the shaft holes 126 of the lid 114 in parallel with the wall portion 132. Two projecting walls 138 are formed in a vertical direction on an outer surface of the wall portion 136.

The pushing member 128 has the shape of a box with a hollow interior, and the top surface 128A is inclined from longitudinally opposite ends of the pushing member 128 toward its center in such a manner as to reduce the height of side walls 140. A pair of shafts 130 is respectively provided projectingly on central portions of both side walls 140. These shafts 130 are respectively inserted from below into a pair of elongated grooves 142 formed vertically in lower portions of the side walls 120 of the accommodating portion 118. Consequently, the pushing member 128 is swingable about the shafts 130 which are pivotally supported at the upper ends of the respective elongated grooves 142.

In addition, a pair of projections 144, which are provided projectingly on lower portions of the side walls 140 of the pushing member 128, are engaged in the elongated grooves 142 while inwardly deflecting the side walls 140, and can be disengaged from the elongated grooves 142. Consequently, when the lower portion of the pushing member 128 is pushed, the projections 144 engage in the elongated grooves 142, thereby locking the pushing member 128.

In addition, when the upper portion of the pushing member 128 is pushed and the pushing member 128 is set in the state shown in FIG. 9, the projections 144 are retained at the edges of the side walls 140, thereby locking the pushing member 128.

Further, a rib 146 is formed at the center of the interior of the pushing member 128, and is retained by a retaining piece 148 which juts diagonally upward from the lower end of the accommodating portion 118, so that the shafts 130 are held so as to not be removed-from the elongated grooves 142. In addition, a stopper 150 reinforced by being provided with a cross section of a cruciform plate is provided projectingly above the rib 146. When the upper portion of the pushing member 128 is pushed, the stopper 150 abuts against the bottom surface 152 of the accommodating portion 118, thereby restricting the swinging motion of the pushing member 128 within a fixed range (see FIG. 9).

Meanwhile, when the lower portion of the pushing member 128 is pushed, the edge portion 158 of the cap body 102 side of the lower end of the pushing member 128 abuts against the lower end of the accommodating portion 118, thereby restricting the swinging motion of the pushing member 128 within a fixed range (see FIG. 8).

An elongated plate-like projection 154 projects upward from the upper end of the pushing member 128. In the state in which the lower portion of the pushing member 128 is pushed in, and the lid 114 is closed, the tip of the projection 154 abuts against the distal end of the wall portion 132.

In addition, a pair of projections 156 projects from vicinities of opposite ends of the projection 154 toward a side surface of the wall portion 136. In the state in which the lower portion of the pushing member 128 is pushed in, and the lid 114 is closed, the interval between the wall portion 136 and each projection 156 is set to be narrower than the interval between the projection 154 and each projecting wall 138. If the upper portion of the pushing member 128 is pushed to swing the pushing member 128, the abutment of the projection 154 against the wall portion 132 is first canceled, and the projections 156 are brought into contact with the side surface of the wall portion 136.

Next, a description will be given of the operation of the cap 100 in accordance with this embodiment.

As shown in FIG. 8, in the state in which the lid 114 is closed, the projections 144 are engaged in the elongated grooves 142 and are locked.

At this time, the insert 116 formed on the reverse surface of the lid 114 is inserted in the pouring port 106. The insert 116 is inserted by expanding the diameter of the thin-walled flexible piece 112, and the thin-walled flexible piece 112 is brought into close contact with the periphery of the insert 116 and seals the same so, even if the container is toppled over, the liquid in the container does not leak from the pouring port 106.

If a force for the lid 114 in the opening direction acts on the lid 114, the wall portion 132 also tends to rotate correspondingly. Here, the distal end of the wall portion 132 abuts against the projection 154, and the force imparted to the pushing member 128 through the wall portion 132 is transmitted to the rib 146. Here, the rib 146 is retained by the retaining piece 148, and angular moment is not produced, so that the pushing member 128 does not swing. Accordingly, the wall portion 132 is locked by the projection 154 of the pushing member 128 which does not swing, with the result that the lid 114 naturally remains closed.

Here, if the upper portion of the pushing member 128 is pushed as shown in FIG. 9, the projections 144 are disengaged from the elongated grooves 142, and the pushing member 128 swings about the shafts 130. As a result of this swinging, the abutment of the projection 154 against the distal end of the wall portion 132 is canceled, and the projections 156 are brought into contact with the side surface of the wall portion 136.

If the upper portion of the pushing member 128 is further pushed, the projections 156 press the side surface of the wall portion 136, and produces angular moment centering around the shaft holes 126 in the lid 114 in the opening direction, thereby opening the lid 114. When the lid 114 is opened to a certain degree, the projections 156 are disengaged from the side surface of the wall portion 136, and the projection 154 presses the projecting walls 138 of the wall portion 136, thereby completely opening the lid 114.

It should be noted that the projecting walls 138 may not necessarily be provided, and are formed, as required, depending on the content filled in the container (in a case where it is sufficient for the lid 114 to be half-opened as in the case of a liquid).

In addition, as shown in FIG. 8, the projections 156 are more distant from the shaft holes 126 than the projection 154, so that the projections 156 produce large angular moment for opening the lid 114, and the operating force during an early period of lid opening is small. However, if the aspect of the operating force is not taken into consideration, the lid 114 may be opened by the projection 154 alone.

Here, when the lid 114 is fully opened, the stopper 150 abuts against the bottom surface 152, restricting the swinging range of the pushing member 128. In this state, the projections 144 are retained at the outer edges of the accommodating portion 118, thereby locking the pushing member 128. In addition, since the projecting walls 138 abut against the projection 154 at this time, the lid 114 is also locked in its open state.

Next, if the lower portion of the pushing member 128 is pushed, the pushing member 128 is swung about the shafts 130, and the projection 154 slides on the projecting walls 138 and is disengaged from the projecting walls 138, allowing the lid 114 to be rotated in the closing direction. Then, a corner of the projection 154 presses the taper 134 of the wall portion 132, and causes the lid 114 to produce angular moment in the closing direction, thereby closing the lid 114. Here, the projections 144 are engaged in the elongated grooves 142, thereby locking the pushing member 128.

Next, FIGS. 10 to 13 show a cap 200 in accordance with a third embodiment of the present invention.

In the same way as the cap 100 of the first embodiment, this cap 200 also has a cap body 202 which is attached to a discharge port portion of an unillustrated container. A pouring port 206, which is constituted by an opening 208 and a hollow cylindrical body 210, is formed on the top surface 204 of the cap body 202. In addition, a thin-walled flexible piece 212 is formed on the hollow cylindrical body 210 as a sealing means.

A pair of elongated grooves 242 is respectively formed in lower portions of a pair of opposing side walls 220 of an accommodating portion 218 recessed in a portion of a side surface of the cap body 202. A pair of shafts 230 projecting from both sides of a pushing member 228 is respectively inserted from below into the elongated grooves 242, thereby axially supporting the pushing member 228 swingably.

A rib 246 is formed at the center of the inside of the pushing member 228, and is retained by a retaining piece 248 located at a lower end of the accommodating portion 218, so as to hold the shafts 230 such that the shafts 230 do not come out from the elongated grooves 242.

The width of an upper portion of the accommodating portion 218 is narrow, and a pair of shafts 222 projects from side walls of this narrow-width portion in mutually opposing directions. A pair of shaft holes 226 is formed in a shaft body 224 which is provided on an inner peripheral portion of a circular lid 214. The shafts 222 are respectively fitted to the shaft holes 226 so as to pivotally support the lid 214. A wall portion 258 is formed on an outer surface of the shaft body 224 in such a manner as to extend toward the shafts 230 of the pushing member 228. An upper end of a pushing member 228 is connected to a lower end of the wall portion 258 (on the outer side of the shaft holes 226) by means of a thin-walled hinge 260. In addition, distal ends on both sides of a lower end portion of the wall portion 258 respectively abut against upper ends of a pair of projections 262 which will be described later.

Figure 10:
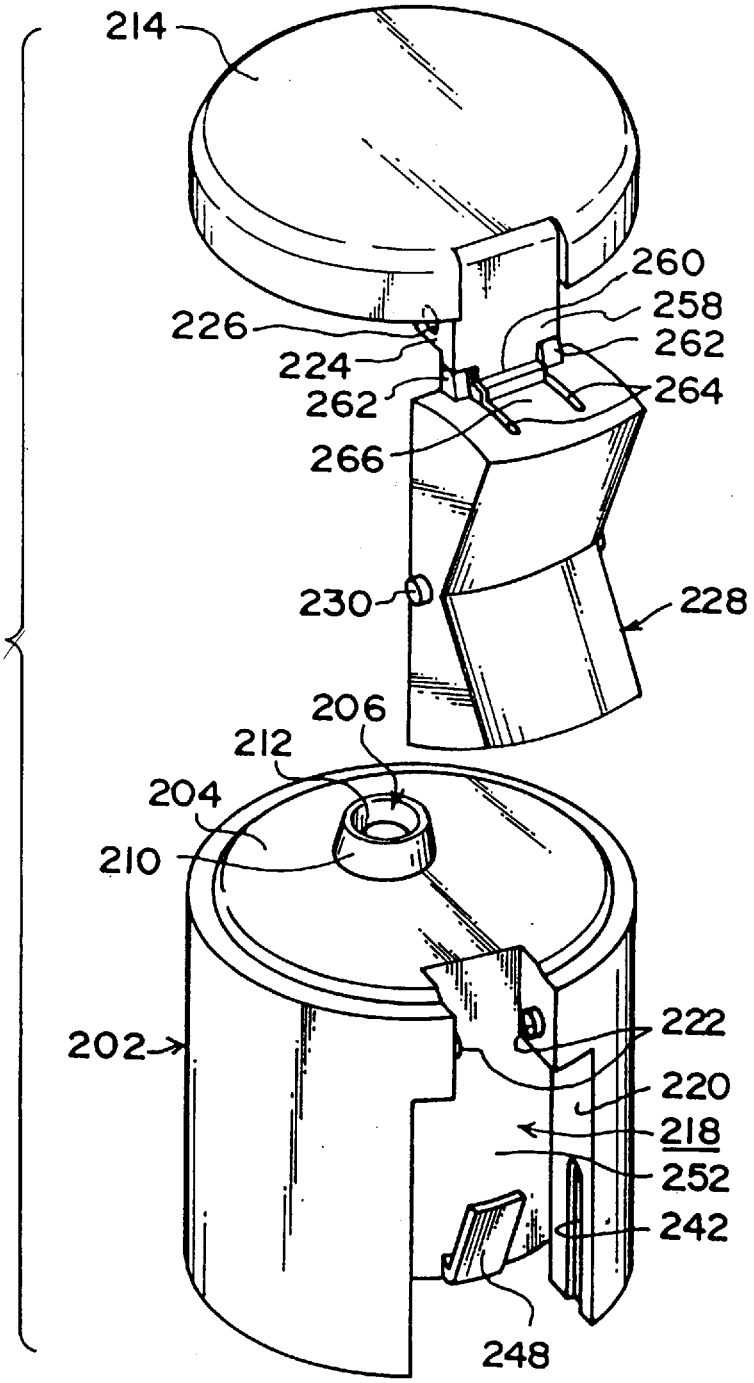
FIG. 10 is an exploded perspective view of a cap in accordance with a third embodiment.

As shown in FIG. 10, two slits 264 are formed in an upper end surface of the pushing member 228 in such a manner that the thin-walled hinge 260 is provided between the slits 264. A remaining portion which is not cut out by the slits 264 is formed as a leaf spring 266, and is capable of exerting a deflecting urging force. Instead of the slits 264, if these portions are formed as thin-walled portions, the portion formed between the thin-walled portions is capable of serving as a leaf spring. The pair of projections 262 is respectively formed on the outer sides of the slits 264 in such a manner as to project upward. In the state in which the lower portion of the pushing member 228 is pushed in and the lid 214 is closed, the tips of the projections 262 abut against the wall portion 258 (see FIG. 11).

Next, a description will be given of the operation of the cap 200 in accordance with the third embodiment.

Figure 11:
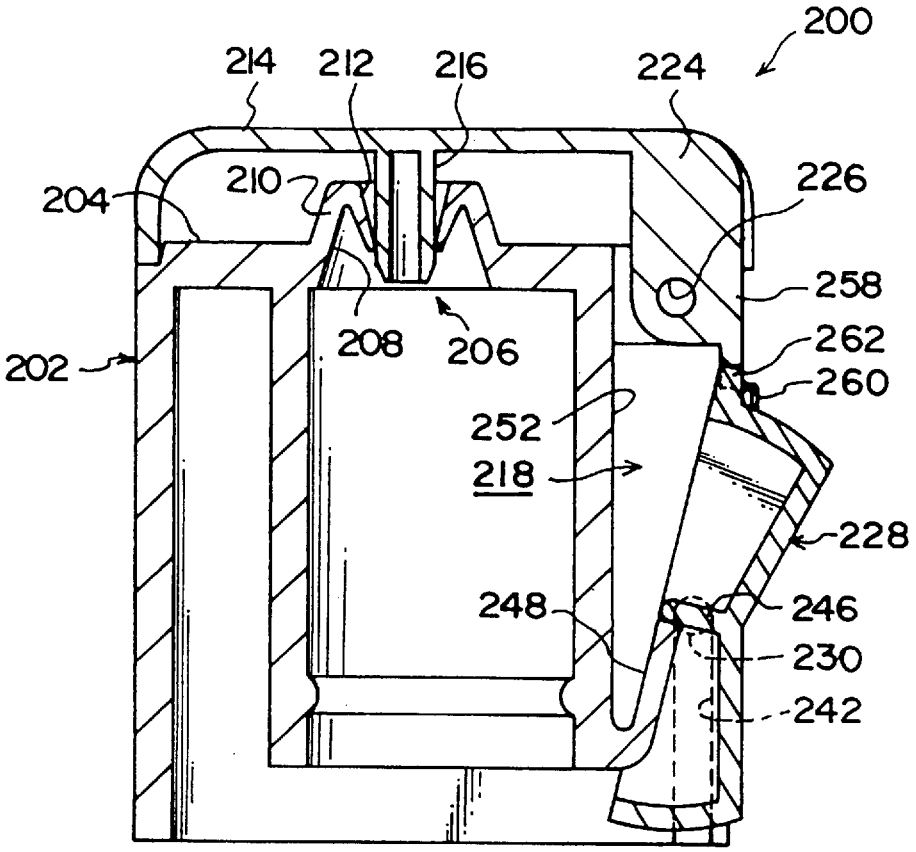
FIG. 11 is a cross-sectional view of the cap in accordance with the third embodiment when the lid is closed.

As shown in FIG. 11, in the state in which the lid 214 is closed, an insert 216 on the reverse surface of the lid 214 is inserted in the pouring port 206 in the same way as in the first embodiment. Since the thin-walled flexible piece 212 is brought into close contact with the periphery of the insert 216 and seals the same, even if the container is toppled over, the liquid in the container does not leak from the pouring port 206.

If a force for the lid 214 in the opening direction acts on the lid 214, the wall portion 258 also tends to rotate correspondingly. Here, the distal end of the wall portion 258 abuts against the projections 262, and the force imparted to the pushing member 228 through the wall portion 258 is transmitted to the rib 246. Here, the rib 246 is retained by the retaining piece 248, and angular moment is not produced, so that the pushing member 228 does not swing. Accordingly, the wall portion 258 is locked by the projections 262 of the pushing member 228 which does not swing, with the result that the lid 214 naturally remains closed.

Figure 12:
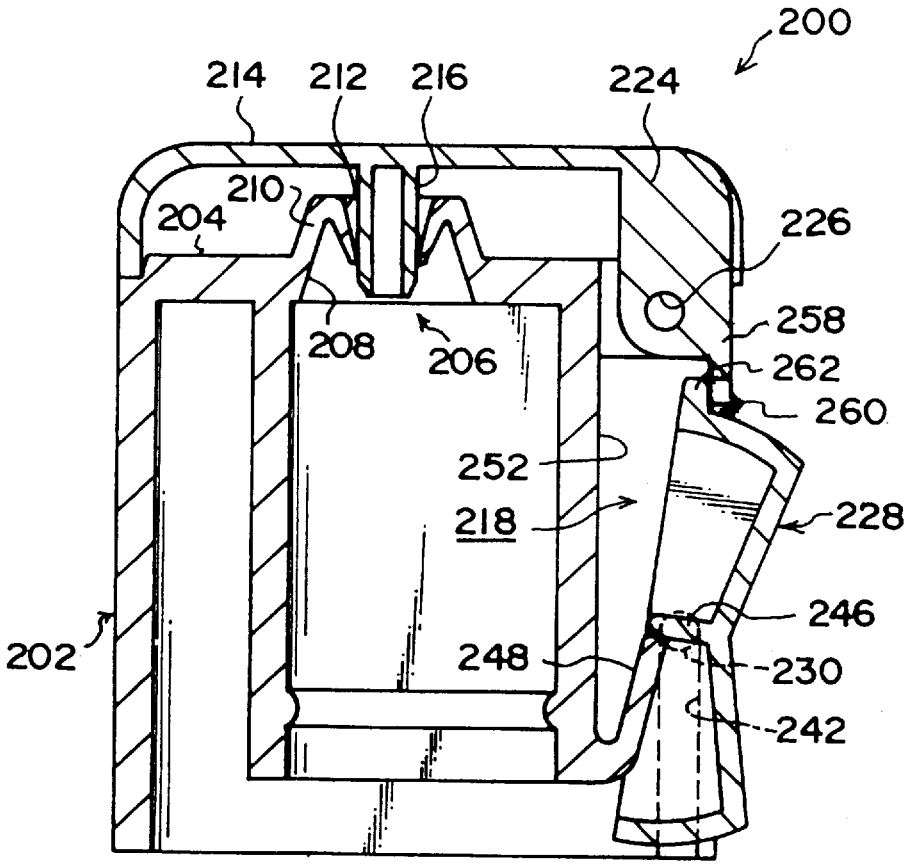
FIG. 12 is a cross-sectional view of the cap in accordance with the third embodiment when abutment between a third wall portion and a third projection is canceled.
Figure 13:
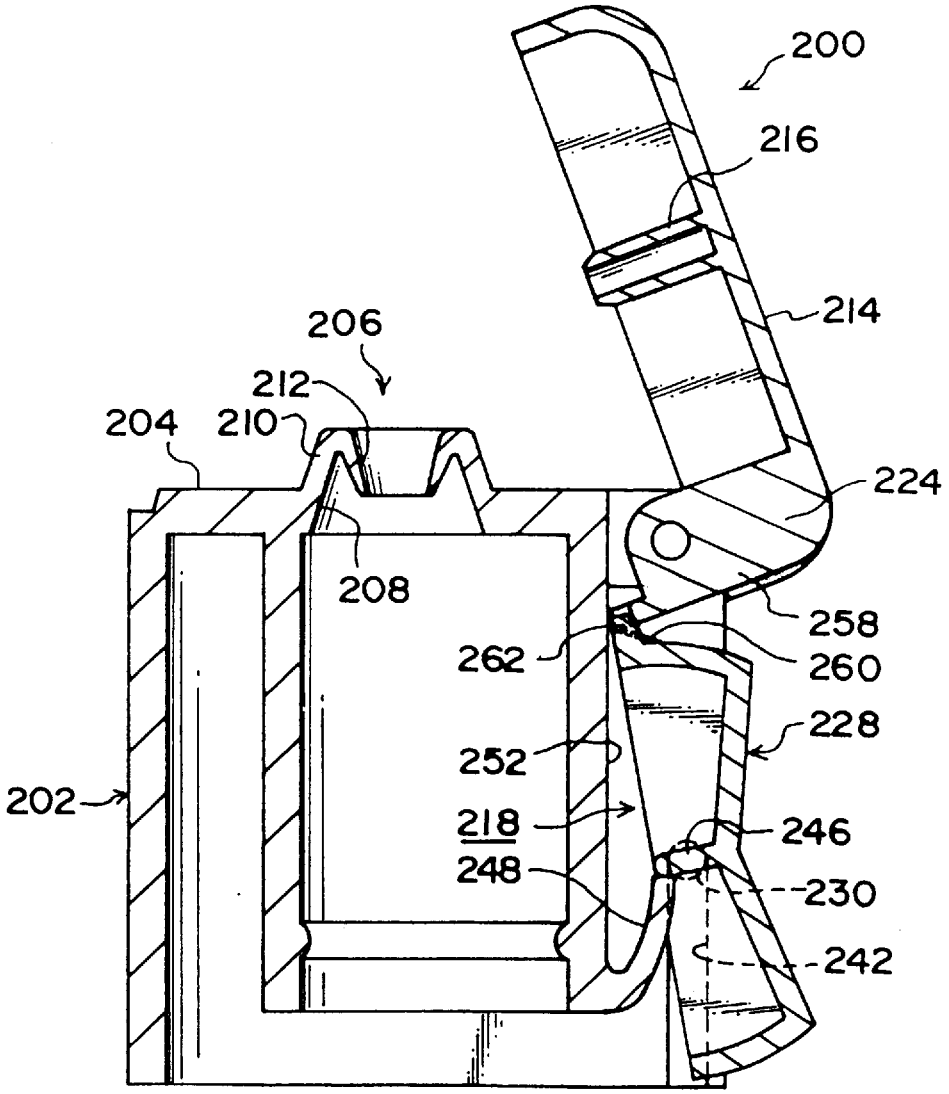
FIG. 13 is a cross-sectional view of the cap in accordance with the third embodiment when the lid is open.
Figure 14:
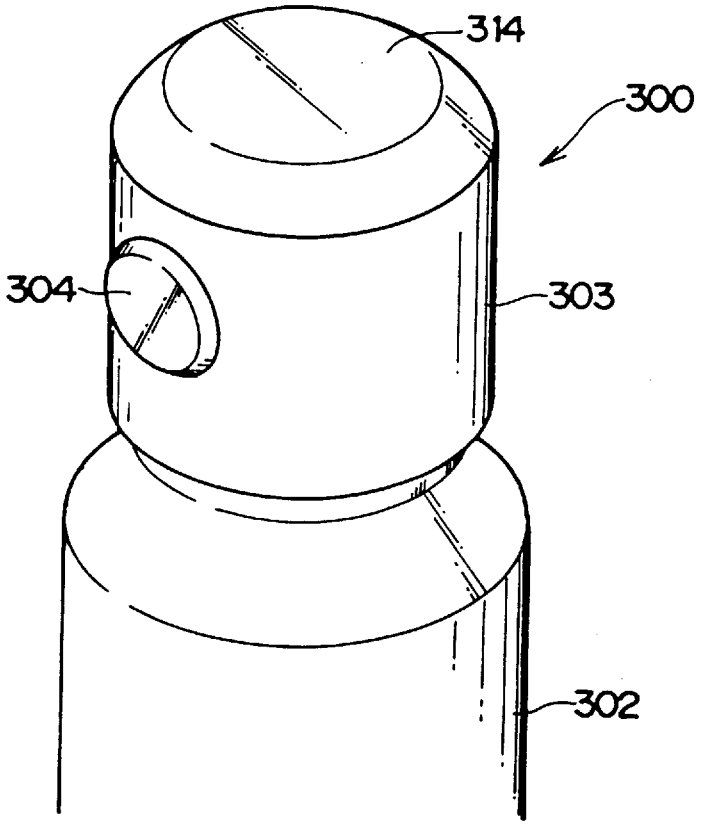
FIG. 14 (PRIOR ART)
FIG. 14 is a perspective view illustrating a conventional cap.
Figure 15:
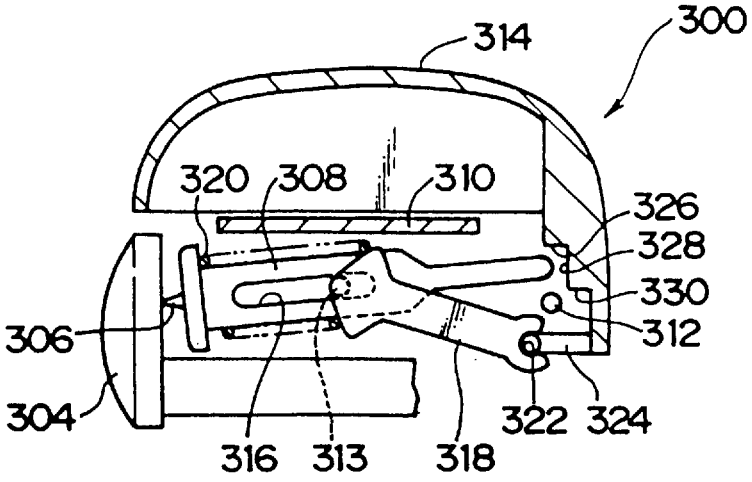
FIG. 15 (PRIOR ART)
FIG. 15 is a cross-sectional view illustrating the opening/closing operation of the conventional cap.
Figure 16:
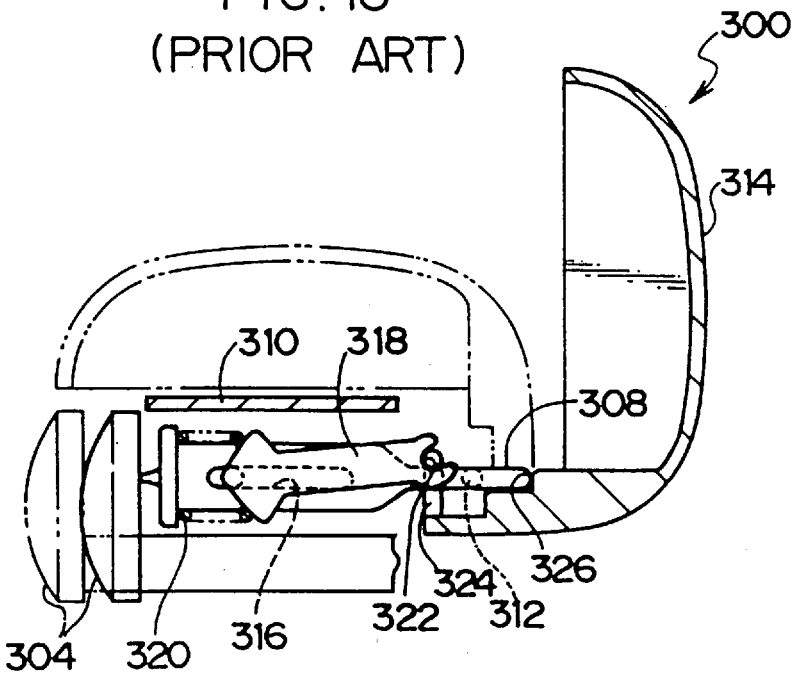
FIG. 16 (PRIOR ART)
FIG. 16 is a cross-sectional view illustrating the opening/closing operation of the conventional cap.
Figure 17:
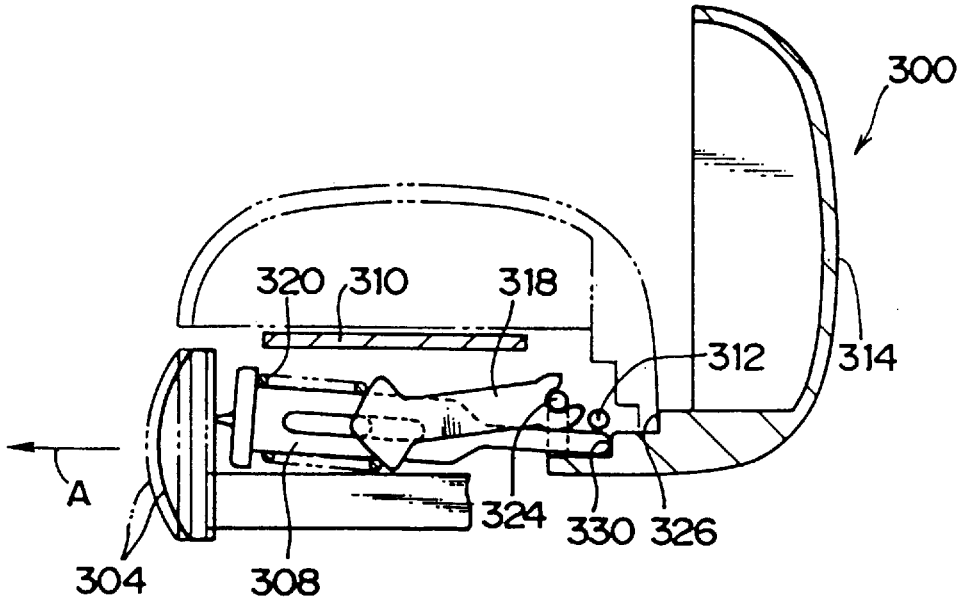
FIG. 17 (PRIOR ART)
FIG. 17 is a cross-sectional view illustrating the opening/closing operation of the conventional cap.
Figure 18:
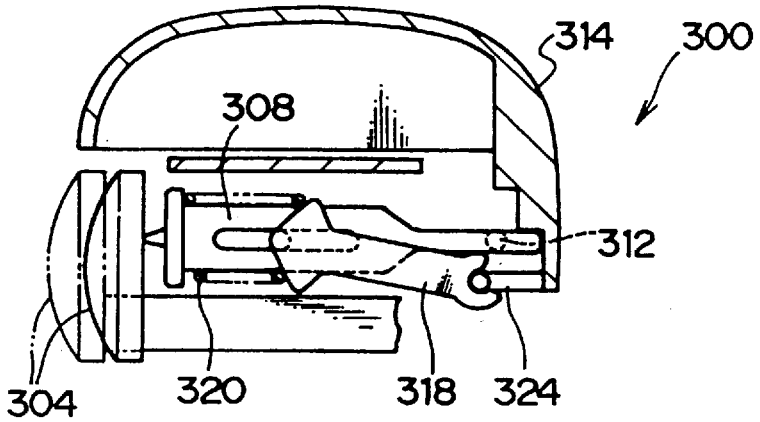
FIG. 18 (PRIOR ART)
FIG. 18 is a cross-sectional view illustrating the opening/closing operation of the conventional cap.

Here, if the upper portion of the pushing member 228 is pushed as shown in FIG. 12, the pushing member 228 is swung about the shafts 230, and the state of abutment between the distal end of the wall portion 258 and the tips of the projections 262 is canceled, thereby rendering the lid 214 rotatable. If the upper portion of the pushing member 228 is further pushed, as shown in FIG. 13, the thin-walled hinge 260 pulls the lower end of the shaft body 224 toward the bottom surface 252 side of the accommodating portion 218, thereby allowing the lid 214 to be opened gradually. At this time, the leaf spring 266 is deflected toward the outer side, and angular moment in the direction of opening the lid 214 is produced about the shafts 222 due to the urging force of the leaf spring 266. Consequently, when the lid 214 is opened by a predetermined angle, the lid 214 is opened automatically.

Next, if the lower portion of the pushing member 228 is pushed, the pushing member 228 is swung about the shafts 230, and corners of the projections 262 press the wall portion 258 and cause angular moment to be produced in the lid 214 in the closing direction, thereby closing the lid 214.

What is claimed is:

1. A cap including a cap body attached to a discharge port portion of a container and having a pouring port through which a content of the container can be discharged, and a lid pivotally supported by the cap body and capable of opening and closing the pouring port, said cap comprising:

a pushing member whose intermediate portion is pivotally supported by a pivotally supporting portion on a side surface of said cap body, said pushing member being swingable about said pivotally supporting portion;

a first wall portion provided projectingly on an outer side of a rotatably supporting portion of said lid toward said pivotally supporting portion of said pushing member;

a second wall portion provided projectingly on an inner side of said rotatably supporting portion of said lid;

a first projection projecting upward from an upper end of said pushing member and abutting against a distal end of said first wall portion when said lid is in a closed state, the abutment of said first projection against the distal end of said first wall portion being canceled to cause said first projection to be inclined toward said second wall portion as an upper portion of said pushing member is operated by being pushed, said first projection being brought into contact with a reverse surface of said first wall portion to cause said lid to rotate in the closing direction as a lower portion of said pushing member is operated by being pushed; and a projecting wall provided on an outer surface of said second wall portion and adapted to be pressed by said first projection as said upper portion of said pushing member is operated by being pushed, so as to rotate said lid in the opening direction.

2. A cap according to claim 1, further comprising:

a second projection provided on a reverse surface of said pushing member in such a manner as to project toward said second wall portion, and adapted to press said second wall portion as the upper portion of said pushing member is operated by being pushed, so as to rotate said lid in the opening direction.

3. A cap according to claim 1, wherein a tapered surface is formed at a corner portion of said first wall portion, and is adapted to rotate said lid in the closing direction when said first projection is brought into contact with said tapered surface as the lower portion of said pushing member is operated by being pushed.

4. A cap according to claim 1, wherein the side surface of said cap body is recessed to form an accommodating portion, and locking means is provided at one end of said pushing member, said locking means being capable of engaging in or disengaging from a pair of grooves which are respectively formed in a pair of side walls of said accommodating portion.

5. A cap according to claim 4, wherein a stopper is provided projecting on a reverse surface of said pushing member for abutting against a bottom surface of said accommodating portion by pushing the upper portion of said pushing member, so as to restrict the range of the swinging motion of said pushing member.

6. A cap according to claim 1, further comprising:

an insert projecting from a reverse surface of said lid and adapted to be inserted into said pouring port with said lid closed; and sealing means formed by a thin-walled flexible piece having a shape of an inverted hollow truncated cone and narrowed from a rim of said pouring port toward an interior of said cap body, so as to seal a periphery of said insert.

* * * * *